US005795441A

United States Patent [19]

Lehleiter et al.

[11] Patent Number: 5,795,441

[45] Date of Patent: Aug. 18, 1998

[54] BREAST BOX FOR A PAPERMAKING MACHINE

[75] Inventors: Klaus Lehleiter, Mengen; Robert Trondle, Ravensburg, both of Germany

[73] Assignee: Voith Sulzer Papiermaschinen GmbH, Heidenheim, Germany

[21] Appl. No.: 544,187

[22] Filed: Oct. 17, 1995

[30] Foreign Application Priority Data

Oct. 18, 1994 [DE] Germany ..... 44 37 181.0

[51] Int. Cl.[6] ..... D21F 1/08

[52] U.S. Cl. ..... 162/343; 162/258; 162/336

[58] Field of Search ..... 162/336, 343, 162/258, 259

[56] References Cited

U.S. PATENT DOCUMENTS

| | | | |
|---|---|---|---|
| 4,539,075 | 9/1985 | Majaniemi | 162/343 |
| 4,888,094 | 12/1989 | Weisshuhn et al. | 162/343 |
| 4,897,158 | 1/1990 | Weisshuhn | 162/259 |
| 5,196,091 | 3/1993 | Hergert | 162/258 |

FOREIGN PATENT DOCUMENTS

| | | |
|---|---|---|
| 3514554 | 3/1986 | Germany . |
| 4019593 | 1/1992 | Germany . |

OTHER PUBLICATIONS

German Office Action of Apr. 12, 1995.

*Primary Examiner*—Karen M. Hastings
*Attorney, Agent, or Firm*—Greenblum & Bernstein P.L.C.

[57] ABSTRACT

Breast box for a papermaking machine. The breast box includes devices in order to add, across the width thereof, localized and dosed material dilution liquids, and located within the breast box is a guiding device having a plurality of channels located immediately downstream of the supply and distribution apparatus, with the guiding device including a multiplicity of inserts in which the channels are located and on whose outer surfaces hollow chambers are formed, wherein the hollow chambers can be filled with the material dilution liquid, the latter then flowing from these hollow chambers into open recesses in the distribution device, with the recesses being directed upstream to the suspension stream existing in the distribution apparatus during the operation thereof.

9 Claims, 3 Drawing Sheets

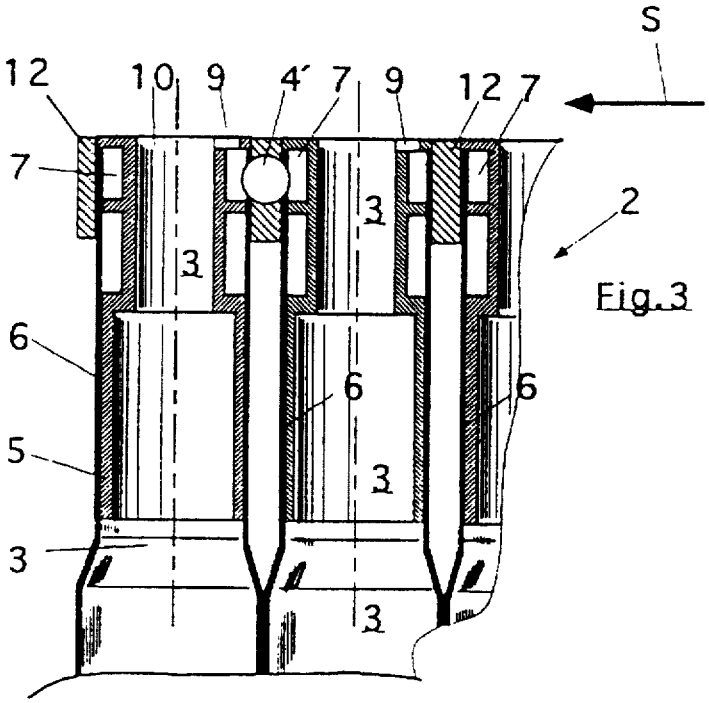
Fig.3
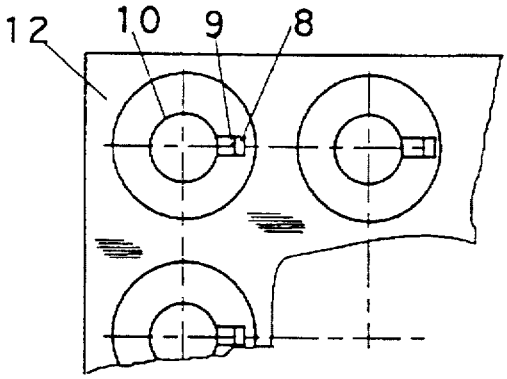
Fig.4
Fig.6
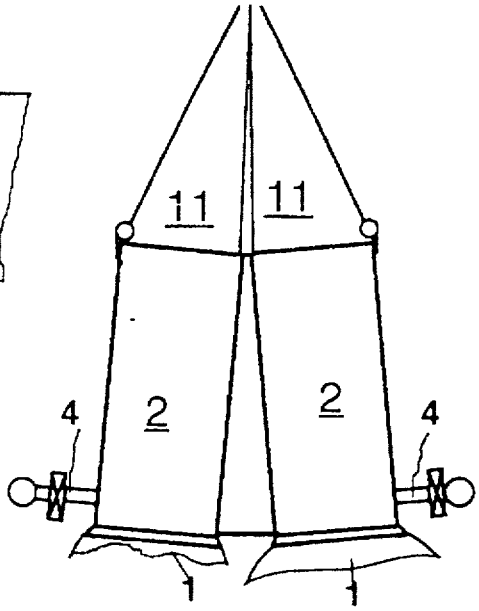
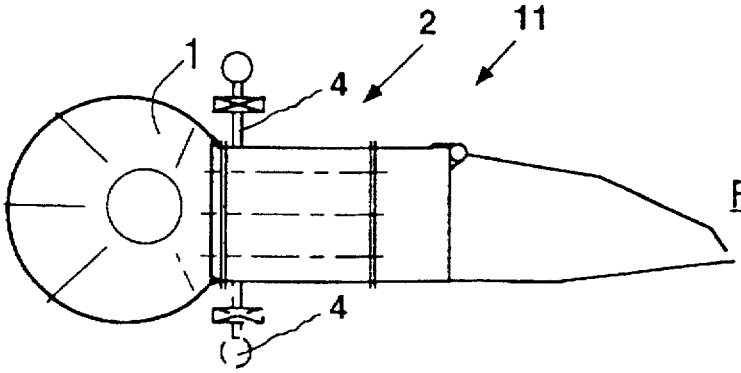
Fig.5

BREAST BOX FOR A PAPERMAKING MACHINE

CROSS REFERENCE TO RELATED APPLICATIONS

This application claims the priority of German Application No. DE P 44 37 181.0, filed Oct. 18, 1994, the disclosure of which is incorporated herein by reference in its entirety.

BACKGROUND OF THE INVENTION

1. Field of the Invention

This invention pertains to a breast box for a papermaking machine with a supply and distribution apparatus for a material suspension, with the distribution apparatus being adjoined in a downstream direction by a guiding device including a plurality of channels for the material suspension as well as a plurality of laterally spaced supply conduits for a material dilution liquid, wherein the channels for the material suspension are located in elongated parallel extending inserts, with a nozzle chamber being further adjoined in a direction downstream of the guiding device for forming an exit aperture for the material suspension.

2. Discussion of the Background of the Invention and Material Information

In modern breast boxes it is a known requirement, at the exit aperture or gap, to be able to adjust the existing suspension over the width thereof. Via this measure, for example, the area weight profile can be controlled or the occurrence of lateral streams or currents in the breast box can be prevented. Generally, for this purpose, geometric changes in the exit gap are utilized, and/or distributed across the width thereof, at several locations, in an intermediate chamber, with the liquid having a material density which varies from that of the suspension stream, such as for example, diluting water.

U.S. Pat. No. 5,196,091, discloses a breast box of the type in which the diluting water is sprayed into a distributor that is located upstream of the guiding device. For this purpose, a relatively large number of supply conduits is required in order to have a sufficiently great influence upon the lateral profile. In that way, if the suspension stream remains sufficiently stable, such a breast box achieves the desired effect.

German Patent Publication DE 40 19 593 C2 discloses a breast box, in which the addition of the fluid is accomplished via inlet openings in the wall of an additional intermediate chamber.

Despite the known solutions, there remains the task or object to produce a breast box, in which at the lowest possible expense, it is possible, during all operating conditions, to add dosages of fluid, for example, diluting water.

SUMMARY OF THE INVENTION

This task or object is completely solved or achieved via a first embodiment of a breast box for a papermaking machine with a supply and distribution apparatus for a material suspension, with the distribution apparatus being adjoined in a downstream direction by a guiding device including a plurality of channels for the material suspension as well as a plurality of laterally spaced supply conduits for a material dilution liquid, wherein the channels for the material suspension are located in elongated parallel extending inserts, with a nozzle chamber being further adjoined in a direction downstream of the guiding device for forming an exit aperture for the material suspension, wherein the elongated parallel extending inserts are provided in guide tubes and are so formed on the periphery thereof so that, between the peripheries thereof and the inner surfaces of the guide tubes, hollow chambers are formed, wherein the supply conduits for the material dilution fluid are each attached at at least one of the hollow chambers, wherein the hollow chambers, thus so supplied with liquid, have at least one connection with a recess open to the distribution apparatus.

In a further embodiment of the breast box of this invention, the recess is a groove that extends from an inlet to one of the channels in an upstream direction to a suspension stream prevailing during the operation of the distribution apparatus.

Another embodiment of this invention pertains to a breast box for a papermaking machine with a supply and distribution apparatus for a material suspension, with the distribution apparatus being adjoined in a downstream direction by a guiding device including a plurality of channels for the material suspension as well as a plurality of laterally spaced supply conduits for a material dilution liquid, wherein the channels for the material suspension are located in elongated parallel extending inserts, with a nozzle chamber being further adjoined in a direction downstream of the guiding device for forming an exit aperture for the material suspension, wherein the elongated parallel extending inserts are so formed on the peripheries thereof that on the peripheries thereof there are outwardly open hollow chambers, the supply conduits for the material dilution liquid each being attached at at least one of the hollow chambers, with the hollow chambers, thus so supplied with liquid, have at least one connection with a recess open to the distribution apparatus.

In another embodiment of the breast box of this invention, the outwardly open hollow chambers, in at least a portion of the inserts, are each subdivided into at least two chambers.

In a differing embodiment of the breast box of this invention, the hollow chambers of respective parallel adjacent inserts, that are supplied with liquid, are so interconnected that the walls of the guide tubes, that adjoin the hollow chambers, are apertured, whereby said hollow chambers are commonly joined to one supply conduit.

In yet a further embodiment of the breast box of this invention, the liquid-supplied hollow chambers of parallel adjacent inserts are so connected with at least one supply conduit that, via the placement of the bore extending from the supply conduit, at least one of the guide tubes, bordering on the respective hollow chambers, are apertured via an opening.

In yet another embodiment of the breast box of this invention, the channels include, at at least two places, discretely expanding stream cross sections.

In yet a differing embodiment of the breast box of this invention, at least 90% of the inserts of the breast box include a recess open to the distribution apparatus, with the recess being connected, via a connection, to at least one hollow chamber, formed via a corresponding insert, to one of the supply conduits for the material dilution liquid.

The inventive solution utilizes the fact that the inserts that include the channels or canals can themselves be inserted in guide tubes. In this manner, as is already known, the inserts are of such a shape that their outer contour includes steps or shoulders which, after the insertion into a guide tube lead to hollow chambers. Specifically, these hollow chambers can advantageously be utilized for the addition of diluting water. Comparable possibilities also occur when the inserts touch in the upstream direction and, as a result of the outer contour thereof, hollow chambers are produced.

Via the features or characteristics of this invention, diluting water can, from the noted hollow chambers, flow directly into the inlets of the associated channel. This has several advantages: First, the addition takes place in the inlet region of the canal, thus producing a particularly good mixing action, since at this inlet maximum possible mixing length extends, namely over the entire channel length. Second, the addition, at this location, does not change the entire amount of the suspension streaming through the channel since, at this location, for example, the increase of the amount of water automatically causes a decrease in the amount of the suspension. Third, this also ensures that the diluting water actually enters the selected channel when the velocity of the suspension in the distribution device changes as a result of differing sheet weights of the papermaking machine. Fourth, since the inserts are arranged in a block, generally in an adjacent and superposed manner, a connection of the hollow chambers between the inserts and the guide tubes or adjacent inserts can readily be accomplished with simple means, in order to be able to control, in a desired manner, the distribution of the diluting fluid. This means that, during the production of such a distribution device, it is possible to form matching connections between the hollow chambers, that are connected with the supply conduits, and thus, via relatively simple means, to so divide the dilution across the entire block of canals or channels so that it corresponds to the requirements at the lowest possible cost. A multiplicity of inserted tubes or pipes, in order to convey the diluting water to the corresponding locations, is not required.

As an additional advantage of specific embodiments it should also be noted that, in case of blockage of the hollow chambers that serve for supplying the diluting water, a simple cleaning is possible since generally the inserts are readily removable. The accompanying depending claims describe particularly advantageous exemplary embodiments of this invention.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein:

FIG. 3 is a partial sectional side view of another embodiment of the breast box of this invention;

FIG. 4 is a top plan view of the breast box of FIG. 3;

FIG. 5 is a simplified schematic side view of a breast box;

FIG. 6 is a simplified schematic side view of a multiple layer breast box;

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
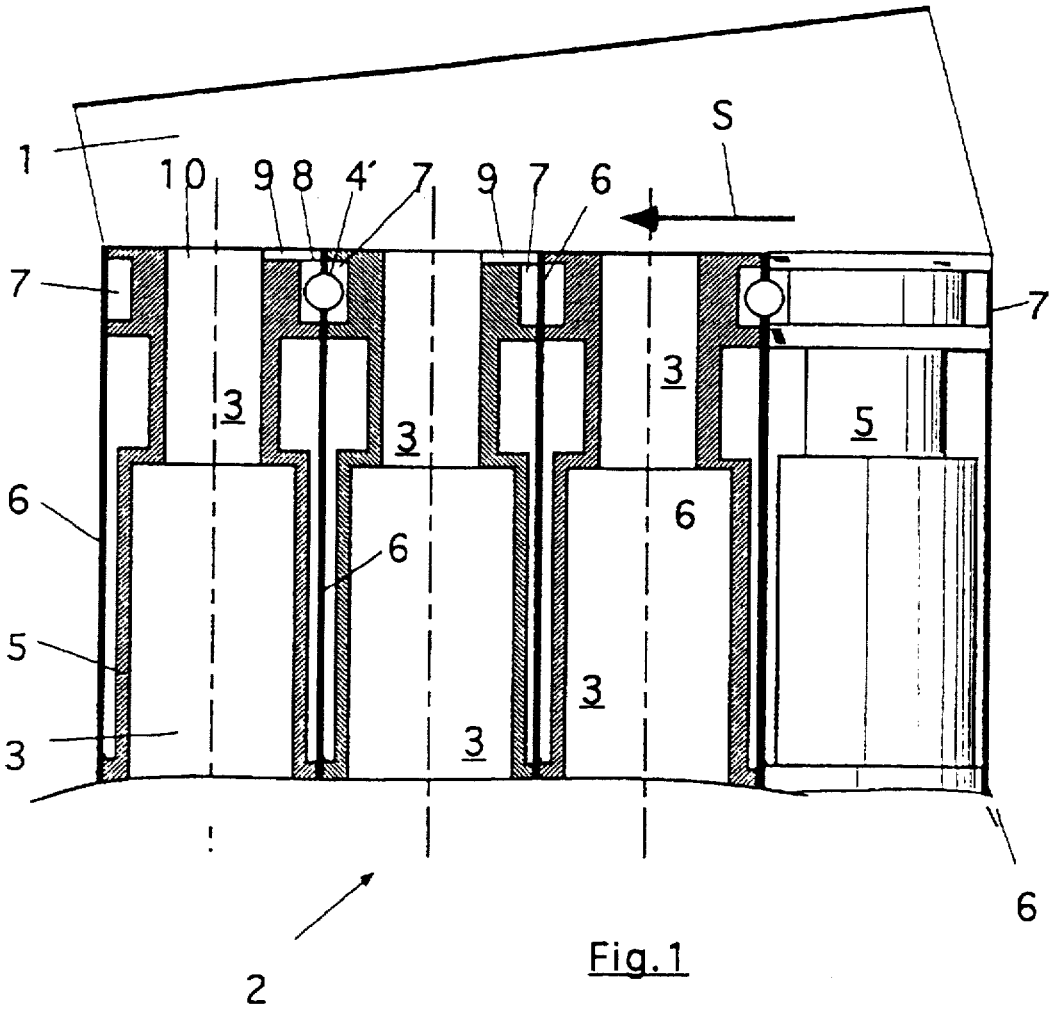
FIG. 1 is a partial sectional side view of one embodiment of the breast box of this invention.

FIG. 1 illustrates, in a simplified schematic manner, a portion of a guiding device 2 of one embodiment of the breast box of this invention. It illustrates a portion of a supply and distribution apparatus 1 within which, during the operation of the breast box, a suspension stream S flows, in this illustration, from right to left. In breast boxes of this type, the suspension stream, at its inlet into the guiding device 2 is split into a plurality of individual streams. Canals or channels 3 serve for this purpose, three of which are shown here in section. Channels 3 are located in the interior of inserts (or insets), 5 and can, as illustrated here, have a circular cross section at least at the beginning thereof, but which are suddenly or abruptly increased in diameter at at least one place. Such breast boxes are also denominated as stepped diffusor breast boxes. The present invention however is also usable with channels that do not have stepped cross sectional increases. It should readily be observable that inserts 5 are contained within sectioned guide tubes 6. In this manner, hollow chambers 7 are formed between inserts or insets 5 and guide tubes 6. Such hollow chambers are already favorable in and of themselves in that they save both material and production time. In accordance with the invention, now at least one hollow chamber 7, per insert 5, is utilized for guiding the material dilution liquid into the material suspension. For this purpose, the supply conduits are connected with hollow chambers 7 in a fluid-supplying manner.

Figure 2:
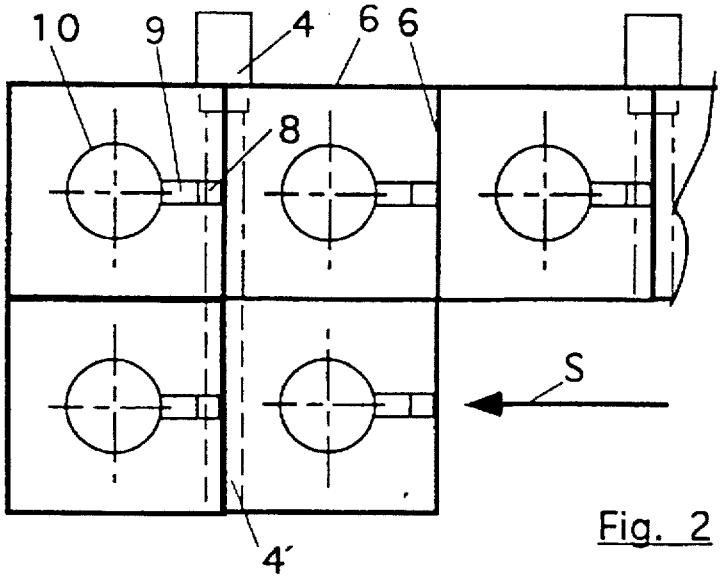
FIG. 2 is a top plan view of the breast box of FIG. 1.

FIGS. 1 and 2 illustrate the particularly favorable embodiments wherein two adjacent hollow chambers 7 can be supplied via one connection. In this manner, directly underneath supply conduit 4, a bore for the production of opening 4' is so recessed that it cuts the walls of adjacent guide tubes 6 just in the region of hollow chambers 7 of adjacent inserts. In this manner, both hollow chambers are connected as a unit onto supply conduit 4. The material dilution liquid flows from hollow chamber 7, via the connection 8, into further recess or clearance 9, which here extends as an open groove or slot directly to inlet 10. As already noted, in this manner, the arrangement as into which channel the fluid is introduced, is certain and is not dependent upon the extent of the stream velocity in supply and distribution apparatus 1.

The right-most insert 5 in FIG. 1 is not shown cross sectioned.

FIG. 2 is essentially a top plan view of the portion of the breast box of FIG. 1. The viewing direction lies in the direction of the channel stream and it should be evident that in this chosen example the guide tubes 6 have a square cross section which aids in the stability of the block. The constructional details for carrying out the invention may be freely chosen as long as the noted hollow chambers can be formed.

In the same manner, as shown in FIG. 3, guide tubes 6 can be utilized whose cross sections are circular upstream and angular downstream. Finally, in such a case, provisions must be made that openings 4' always cut two adjacent tubes. The FIG. 3 construction has the advantage of having relatively short inserts 5 since the guide tubes 6 in the downstream direction are themselves media-containing.

As illustrated in FIG. 4, the FIG. 3 embodiment, in the upstream direction, can include an apertured plate 12 in order to separate the hollow chambers 7 that are located perpendicular to the machine running direction.

FIG. 5 illustrates, in a greatly simplified manner, a side view of the entire breast box. At the lower portion (in broken lines) a bottom mounted supply conduit 4 can be used as an alternative or also as a supplement with reference to top-mounted supply conduit 4.

FIG. 6 illustrates, in a greatly simplified manner, an unsectioned side view of a multiple layer breast box of this invention and shows the supply and distribution apparatus 1, guiding devices 2, supply conduits 4 and nozzle chambers 11. This breast box serves for the outlet of a material stream vertically upwardly and can thus also be utilized in double or twin screen gap formers having a vertical forming section. This example or embodiment illustrates that the invention, described up to now as having a horizontal breast box can also readily be utilized in a position wherein the position or location of the material stream deviates therefrom.

Figure 7:
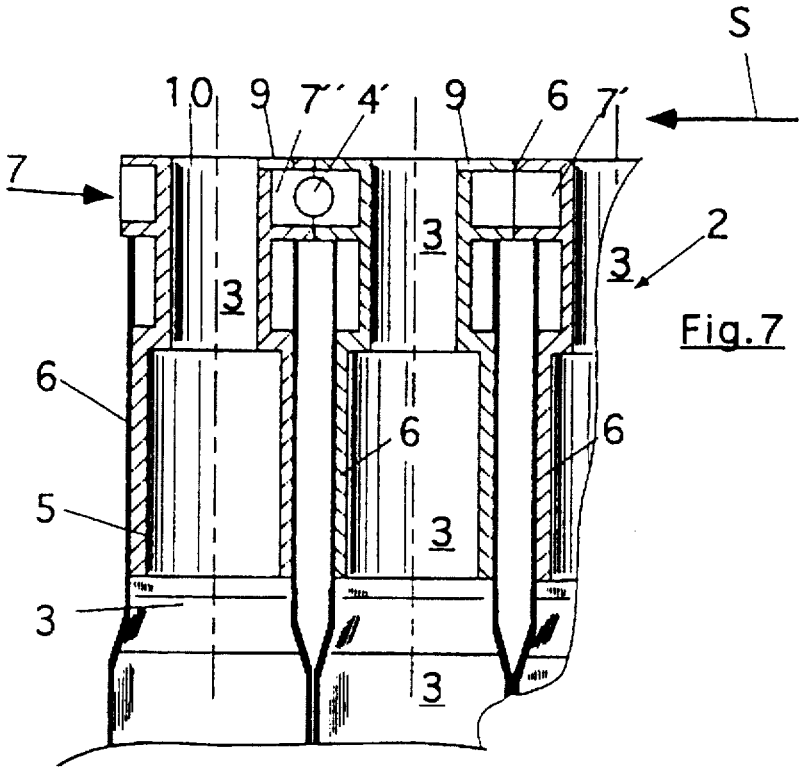
FIG. 7 is a partial sectional side view of yet a further embodiment of the breast box of this invention.

FIG. 7 illustrates an embodiment wherein the hollow chambers 7 of two adjacent inserts 5 directly adjoin each other. It is into such hollow chambers that a bore can be recessed for the production of openings 4'.

Guide tubes 6 do not extend to the upstream end of the inserts or insets 5. Guide tubes 6 can possibly even be totally omitted when inserts 5 are so shaped that they can be connected with each other.

Figure 8:
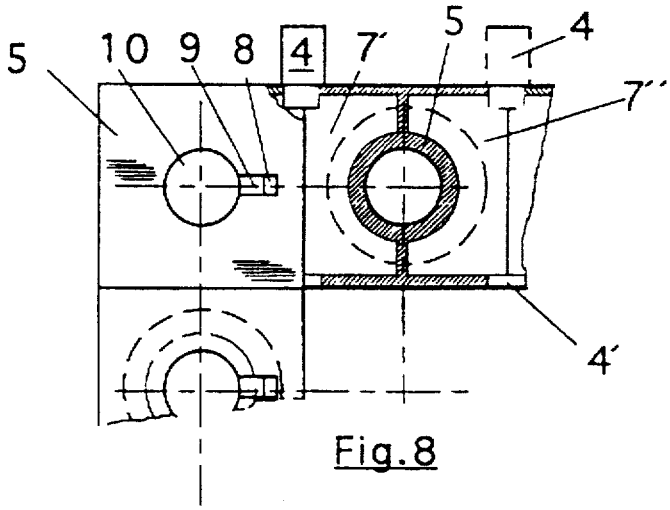
FIG. 8 is a top plan view of the breast box of FIG. 7.

FIG. 8, in partial section, is a top plan view of the embodiment of FIG. 7. The hollow chamber 7 of one insert 5 is divided into two chambers 7', 7". It depends upon the requirements of the breast box as to how finely divided, when viewed across the breadth of the breast box, the material dilution fluid is to be added. The insert 5, shown sectioned in FIG. 8, which is divided into two chambers 7', 7", separates two chargeable dilution zones that are independently supplied or chargeable via supply conduits 4. When, in this noted insert one or more additional inserts are situated adjacent thereto without a separation into two chambers, several vertically extending rows of such inserts are consolidated in a further zone.

In the multiplicity of known basic constructions, other embodiments not illustrated in detail here, can also be realized with the invention defined in the appended claims. Its utilization in gap-formers, elongated screen formers or hybrid formers is also feasible.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A breast box for a papermaking machine having a supply and distribution apparatus for material suspension flow and a guiding device coupled in a downstream direction from the supply and distribution apparatus, said guiding device comprising:

a plurality of channels, each channel receiving at least a portion of the material suspension;

a plurality of laterally spaced supply conduits supplying a material dilution liquid;

a plurality of elongated parallel extending inserts each of the plurality of channels located within a respective elongated parallel extending insert;

a nozzle chamber coupled in a direction downstream of the guiding device, that forms an exit aperture for the material suspensions a plurality of guide tubes, each of the plurality of guide tubes receiving a respective elongated parallel extending insert, and forming a hollow chamber along a periphery of the guide tube between an outer surface of the respective elongated parallel extending insert and an inner surface of the guide tube;

each of the plurality of laterally spaced supply conduits coupled to at least one of the hollow chambers; and a recess, associated with at least one of the plurality of channels and open to the supply and distribution apparatus, coupled to one of the hollow chambers.

2. The breast box of claim 1, wherein the recess is a groove that extends from an inlet to one of the channels in an upstream direction to a suspension stream prevailing during the operation of the distribution apparatus.

3. The breast box of claim 1, wherein the hollow chambers of respective parallel adjacent inserts, that are supplied with liquid, are so interconnected that the walls of the guide tubes, that adjoin the hollow chambers, are apertured, whereby said hollow chambers are commonly joined to one supply conduit.

4. The breast box of claim 2, wherein the hollow chambers of respective parallel adjacent inserts, that are supplied with liquid, are so interconnected that the walls of the guide tubes, that adjoin the hollow chambers, are apertured, whereby said hollow chambers are commonly joined to one supply conduit.

5. The breast box of claim 1, wherein the channels include, at at least two places, discretely expanding stream cross sections.

6. The breast box of claim 3, wherein the channels include, at at least two places, discretely expanding stream cross sections.

7. The breast box of claim 1, wherein at least 90% of the plurality of the inserts of the breast box include an insert recess open to the supply and distribution apparatus, with the insert recess being connected to at least one of the hollow chambers formed between adjacent inserts and to one of the supply conduits for the material dilution liquid.

8. The breast box of claim 3, wherein at least 90% of the plurality of the inserts of the breast box include an insert recess open to the supply and distribution apparatus, with the insert recess being connected to at least one of the hollow chambers formed between adjacent inserts and to one of the supply conduits for the material dilution liquid.

9. The breast box of claim 5, wherein at least 90% of the plurality of the inserts of the breast box include an insert recess open to the supply and distribution apparatus, with the insert recess being connected to at least one of the hollow chambers formed between adjacent inserts and to one of the supply conduits for the material dilution liquid.

* * * * *